US006561348B2

(12) United States Patent
Kuo

(10) Patent No.: US 6,561,348 B2
(45) Date of Patent: May 13, 2003

(54) BILLIARD CUE BAG WITH COVER LOCKING DEVICE

(76) Inventor: Hsueh-Hsing Kuo, 9F, No. 146-29, Sec. 1, Tung-Shan Rd., Pei-Tun Dist., Taichung City (TW)

( * ) Notice: Subject to any disclaimer, the term of this patent is extended or adjusted under 35 U.S.C. 154(b) by 12 days.

(21) Appl. No.: 09/965,511

(22) Filed: Sep. 26, 2001

(65) Prior Publication Data

US 2003/0057120 A1 Mar. 27, 2003

(51) Int. Cl.[7] ..... B65D 85/20
(52) U.S. Cl. ..... 206/315.1; 206/443; 206/1.5
(58) Field of Search ..... 206/315.1, 1.5, 206/443, 579; 190/119, 120, 121, 109

(56) References Cited

U.S. PATENT DOCUMENTS 5,102,529 A * 4/1992 Hickin ..... 206/315.3
5,350,150 A * 9/1994 Fiore ..... 248/552

* cited by examiner

*Primary Examiner*—Jacob K. Ackun
(74) *Attorney, Agent, or Firm*—Marger Johnson & McCollom, P.C.

(57) ABSTRACT

A billiard cue bag includes a main bag body, a cover part, and a cover locking device. The main bag body has a top portion that defines an access opening. The cover part is hinged to the top portion of the main bag body, and is movable relative to the main bag body between closed and open positions for closing and opening the access opening, respectively. The cover locking device includes a rotatable fastener unit mounted on the main bag body, a retaining flap connected to the cover part, and a lock body connected removably to the fastener unit. The fastener unit includes an elongate base part, an elongate rotary part, and a lock retaining flange that is formed with a shackle engaging hole for removable retention of a shackle of the lock body.

2 Claims, 3 Drawing Sheets

BILLIARD CUE BAG WITH COVER LOCKING DEVICE

BACKGROUND OF THE INVENTION

1. Field of the Invention

The invention relates to a billiard cue bag, more particularly to a billiard cue bag with a cover locking device.

2. Description of the Related Art

Referring to FIG. 1, a conventional billiard cue bag 1 is shown to comprise a main bag body 11 and a cover part 12. The main bag body 11 is adapted to receive segments of a billiard cue (not shown) therein, and has a top portion 110 with an outer wall surface 1101. The top portion 110 defines an access opening 111. The cover part 12 is hinged to the top portion 110 of the main bag body 11, and is movable relative to the main bag body 11 between closed and open positions for closing and opening the access opening 111, respectively. The main bag body 11 has a female fastener 112 secured to the outer wall surface 1101 of the top portion 110 of the main bag body 11. A retaining flap 121 is connected to the cover part 12, and has a male fastener 1211 that engages removably the female fastener 112 of the main bag body 11 to retain the cover part 12 releasably at the closed position.

The segments of the billiard cue (not shown) can be protected from humidity when the cover part 12 is at the closed position and the male and female fasteners 1211, 112 are inter-engaged. However, the fasteners 1211, 112 are easily disengaged by external applied forces. If the locking strength of the male and female fasteners 1211, 112 is strengthened, the user will encounter difficulty in opening the conventional billiard cue bag 1.

SUMMARY OF THE INVENTION

Therefore, the main object of the present invention is to provide a billiard cue bag with a cover locking device that is capable of overcoming the aforementioned drawbacks of the prior art.

Accordingly, a billiard cue bag of the present invention comprises a main bag body, a cover part, and a cover locking device. The main bag body is adapted to receive segments of a billiard cue therein, and has a top portion with an outer wall surface. The top portion defines an access opening. The cover part is hinged to the top portion of the main bag body, and is movable relative to the main bag body between closed and open positions for closing and opening the access opening, respectively. The cover locking device includes a rotatable fastener unit mounted on the main bag body, a retaining flap connected to the cover part, and a lock body connected removably to the fastener unit. The fastener unit includes an elongate base part, an elongate rotary part, and a lock retaining flange. The elongate base part is secured to the outer wall surface of the top portion of the main bag body. The elongate rotary part has a mounting end and a distal end. The mounting end is mounted rotatably on one side of the base part opposite to the outer wall surface of the top portion of the main bag body. The distal end is opposite to the mounting end in a transverse direction relative to the outer wall surface of the top portion of the main bag body. The rotary part has a length and a width less than those of the base part. The length of the rotary part is greater than the width of the base part. The lock retaining flange projects in the transverse direction from the distal end of the rotary part, is formed with a shackle engaging hole, and has a length and a width less than those of the base part. The retaining flap is formed with an elongate slot that has a size and shape corresponding to those of the base part. The rotary part is rotatable relative to the base part from a releasing position to a retaining position. In the releasing position, the rotary part extends generally parallel to the elongate slot, and the lock retaining flange and the rotary part are extendible through the elongate slot so as to enable the base part to extend into the elongate slot and so as to enable the retaining flap to lie against the outer wall surface of the top portion of the main bag body for disposing the cover part at the closed position. In the retaining position, the rotary part extends generally transverse to the elongate slot such that the retaining flap can be restricted thereby from moving away from the outer wall surface of the top portion of the main bag body. The lock body has a shackle retained removably on the lock retaining flange at the shackle engaging hole.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
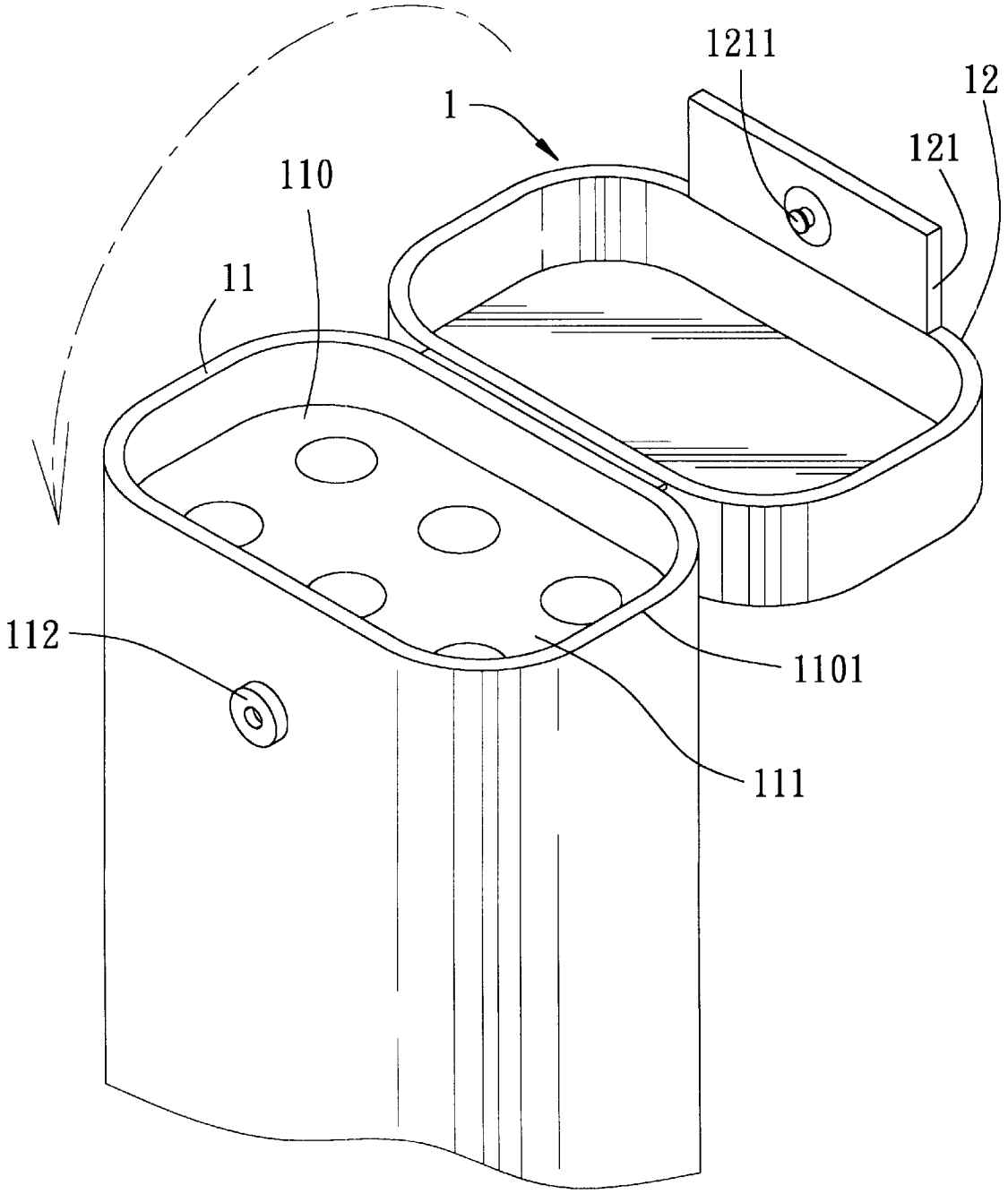
FIG. 1 PRIOR ART
FIG. 1 is a fragmentary perspective view of a conventional billiard cue bag.
Figure 2:
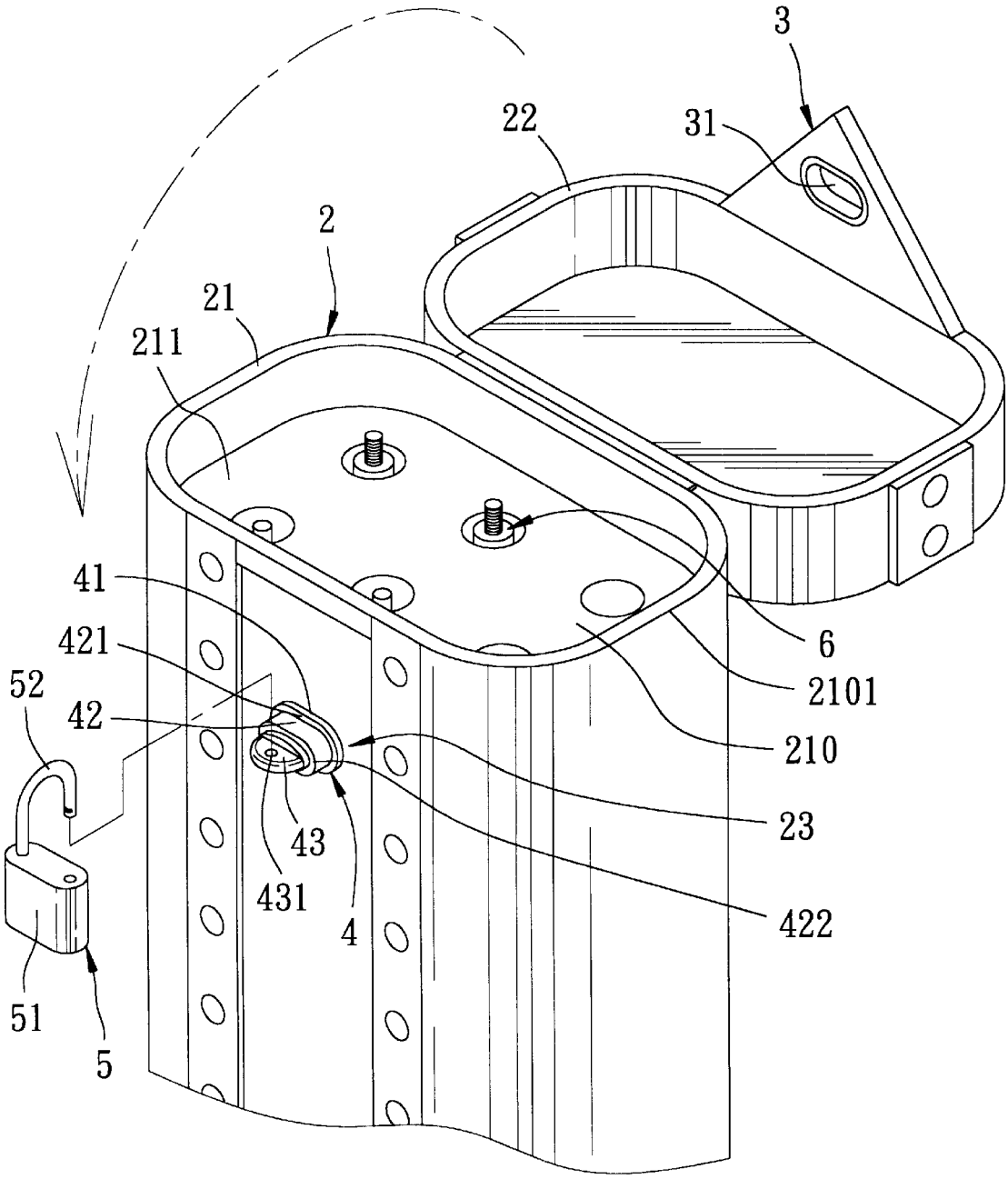
FIG. 2 is a fragmentary perspective view of the preferred embodiment of a billiard cue bag according to the present invention.

Referring to FIG. 2, the preferred embodiment of a billiard cue bag 2 according to the present invention is shown to comprise a main bag body 21, a cover part 22, and a cover locking device 23. The main bag body 21 is adapted to receive segments of a billiard cue 6 therein, and has a top portion 210 with an outer wall surface 2101. The top portion 210 defines an access opening 211. The cover part 22 is hinged to the top portion 210 of the main bag body 21, and is movable relative to the main bag body 21 between closed and open positions for closing and opening the access opening 211, respectively. The cover locking device 23 includes a rotatable fastener unit 4 mounted on the main bag body 21, a triangular retaining flap 3 connected to the cover part 22, and a lock body 5 connected removably to the fastener unit 4.

The fastener unit 4 includes an elongate base part 41, an elongate rotary part 42, and a lock retaining flange 43. The elongate base part 41 is secured to the outer wall surface 2101 of the top portion 210 of the main bag body 21. The elongate rotary part 42 has a mounting end 421 and a distal end 422. The mounting end 421 is mounted rotatably on one side of the base part 41 opposite to the outer wall surface 2101 of the top portion 210 of the main bag body 21. The distal end 422 is opposite to the mounting end 421 in a transverse direction relative to the outer wall surface 2101 of the top portion 210 of the main bag body 21. The rotary part 42 has a length and a width less than those of the base part 41. The length of the rotary part 42 is greater than the width of the base part 41. The lock retaining flange 43 projects in the transverse direction from the distal end 422 of the rotary part 42, is formed with a shackle engaging hole 431, and has a length and a width less than those of the base part 41.

The triangular retaining flap 3 is formed with an elongate slot 31 in a central portion thereof. The elongate slot 31 has a size and shape corresponding to those of the base part 41.

Figure 3:
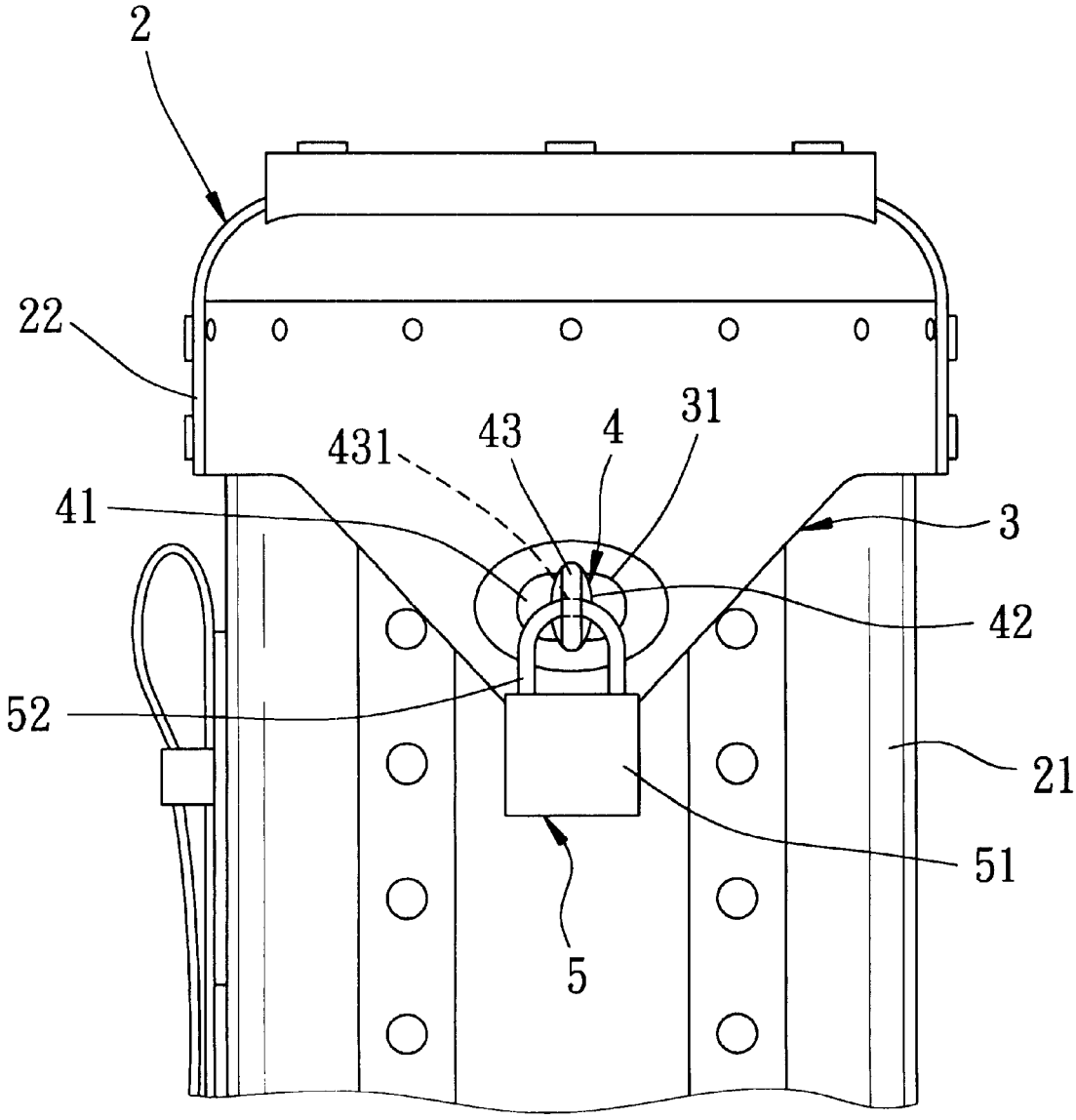
FIG. 3 is a fragmentary schematic view of the billiard cue bag of FIG. 2 at a closed state.

The rotary part 42 is rotatable relative to the base part 41 from a releasing position to a retaining position. In the releasing position, the rotary part 42 extends generally parallel to the elongate slot 31. Under such a condition, the lock retaining flange 43 and the rotary part 42 are extendible through the elongate slot 31, thereby enabling the base part 41 to extend into the elongate slot 31, and thereby enabling the retaining flap 3 to lie against the outer wall surface 2101 of the top portion 210 of the main bag body 21 so as to dispose the cover part 22 at the closed position. In the retaining position, the rotary part 42 extends generally transverse to the elongate slot 31 such that the retaining flap 3 can be restricted thereby from moving away from the outer wall surface 2101 of the top portion 210 of the main bag body 21, as best shown in FIG. 3.

In this embodiment, the lock body 5 is a known key-operated padlock having a lock core 51 and an inverted U shackle 52 associated with the lock core 51 and retained removably on the lock retaining flange 43 at the shackle engaging hole 431.

In use, the cover part 12 is initially at the open position to enable the user to retrieve segments of the billiard cue 6 from the billiard cue bag 2. After use, the cover part 12 is moved to the closed position, the fastener unit 4 is extended through the elongate slot 31 in the retaining flap 3, and the rotary part 42 is rotated to the retaining position. The lock body 5 is retained on the fastener unit 4 to prevent stealing of the billiard cue 6 and loosening of the cover part 22.

It should be noted that the user has to use force to move the rotary part 42 to the retaining position so as to retain the cover part 22 at the closed position. Unlike the conventional billiard cue bag 1, force is exerted on the rotary part 42 of the fastener unit 4, thereby preventing damage to the cover part 22.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A billiard cue bag, comprising:

a main bag body adapted to receive segments of a billiard cue therein, said main bag body having a top portion with an outer wall surface, said top portion defining an access opening;

a cover part hinged to said top portion of said main bag body, said cover part being movable relative to said main bag body between closed and open positions for closing and opening said access opening, respectively; and a cover locking device including a rotatable fastener unit mounted on said main bag body, a retaining flap connected to said cover part, and a lock body connected removably to said fastener unit;

said fastener unit including an elongate base part secured to said outer wall surface of said top portion of said main bag body, an elongate rotary part having a mounting end mounted rotatably on one side of said base part opposite to said outer wall surface of said top portion of said main bag body, and a distal end opposite to said mounting end in a transverse direction relative to said outer wall surface of said top portion of said main bag body, said rotary part having a length and a width less than those of said base part, the length of said rotary part being greater than the width of said base part, and a lock retaining flange projecting in the transverse direction from said distal end of said rotary part, said lock retaining flange being formed with a shackle engaging hole, and having a length and a width less than those of said base part;

said retaining flap being formed with an elongate slot that has a size and shape corresponding to those of said base part;

said rotary part being rotatable relative to said base part from a releasing position, where said rotary part extends generally parallel to said elongate slot such that said lock retaining flange and said rotary part are extendible through said elongate slot so as to enable said base part to extend into said elongate slot and so as to enable said retaining flap to lie against said outer wall surface of said top portion of said main bag body for disposing said cover part at the closed position, to a retaining position, where said rotary part extends generally transverse to said elongate slot such that said retaining flap can be restricted thereby from moving away from said outer wall surface of said top portion of said main bag body;

said lock body having a shackle retained removably on said lock retaining flange at said shackle engaging hole.

2. The billiard cue bag of claim 1, wherein said lock body is a key-operated padlock.

* * * * *